US008875314B1

(12) United States Patent
Panetta

(10) Patent No.: US 8,875,314 B1
(45) Date of Patent: Nov. 4, 2014

(54) TOOL KIT VEST ASSEMBLY

(71) Applicant: Joseph R. Panetta, Madison, CT (US)

(72) Inventor: Joseph R. Panetta, Madison, CT (US)

( * ) Notice: Subject to any disclaimer, the term of this patent is extended or adjusted under 35 U.S.C. 154(b) by 0 days.

(21) Appl. No.: 13/870,531

(22) Filed: Apr. 25, 2013

(51) Int. Cl.
*A41D 1/04* (2006.01)
*A45F 5/02* (2006.01)

(52) U.S. Cl.
CPC .. *A45F 5/02* (2013.01); *A45F 5/022* (2013.01)
USPC ..... 2/102

(58) Field of Classification Search
USPC ..... 2/102, 2.5, 94, 455, 462, 463, 467, 2/247–253, 920
See application file for complete search history.

(56) References Cited

U.S. PATENT DOCUMENTS 3,529,307 A 9/1970 Belson et al.
4,106,121 A 8/1978 Belson
4,369,526 A 1/1983 Clutts
5,211,321 A 5/1993 Rodriguez
5,617,582 A 4/1997 Burwell
5,991,925 A * 11/1999 Wu ..... 2/102
6,185,738 B1 * 2/2001 Sidebottom ..... 2/2.5
6,662,373 B2 12/2003 Frank
D641,960 S 7/2011 Goff et al.
D658,852 S 5/2012 McCoy
2008/0301863 A1 12/2008 Goff et al.

* cited by examiner

*Primary Examiner* — Tejash Patel

(57) ABSTRACT

A tool kit vest assembly securely holds and provides easy access to tools, allows for adjustment of the vest, and provides ventilation to dissipate heat. The assembly includes a flexible panel having a first end and a second end. An aperture is positioned in the panel between the first end and the second end and between a pair of lateral sides of the panel. A dorsal portion of the panel extends from the aperture to the first end of the panel. A pocket is coupled to the panel. A flap is coupled to the pocket and is positionable between an opened position and a closed position. An interior fastener couples the flap to the pocket when the flap is in the closed position. An exterior fastener couples the flap to the panel when the flap is in the opened position.

20 Claims, 5 Drawing Sheets

TOOL KIT VEST ASSEMBLY

BACKGROUND OF THE DISCLOSURE

Field of the Disclosure

The disclosure relates to vest assemblies and more particularly pertains to a new vest assembly for securely holding and providing easy access to tools, allowing adjustment of the vest for a better fit, and providing ventilation to dissipate heat accumulated within the vest.

SUMMARY OF THE DISCLOSURE

An embodiment of the disclosure meets the needs presented above by generally comprising a flexible panel having a first end, a second end, and a pair of lateral sides extending between the first end and the second end. An aperture is positioned in the panel between the first end and the second end and between the lateral sides of the panel. The aperture defines a dorsal portion of the panel extending from the aperture to the first end of the panel when the panel is draped over shoulders of a person while a neck of the person extends through the aperture. A pocket is coupled to the panel and has an open top end, a closed bottom end, and a perimeter wall extending between the open top end and the closed bottom end. The closed bottom end and the perimeter wall define an interior space configured for holding a plurality of tools. A top edge of the perimeter wall defines an opening into the interior space. A flap is coupled to the pocket and is positionable between an opened position and a closed position wherein the flap closes the opening when the flap is in the closed position and the flap exposes the opening when the flap is in the opened position. An interior fastener couples the flap to the pocket when the flap is in the closed position. An exterior fastener couples the flap to the panel when the flap is in the opened position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other that those set forth above will become apparent when consideration is given to the following detailed description thereof. Such description makes reference to the annexed drawings wherein.

DESCRIPTION OF THE PREFERRED EMBODIMENT

Figure 1:
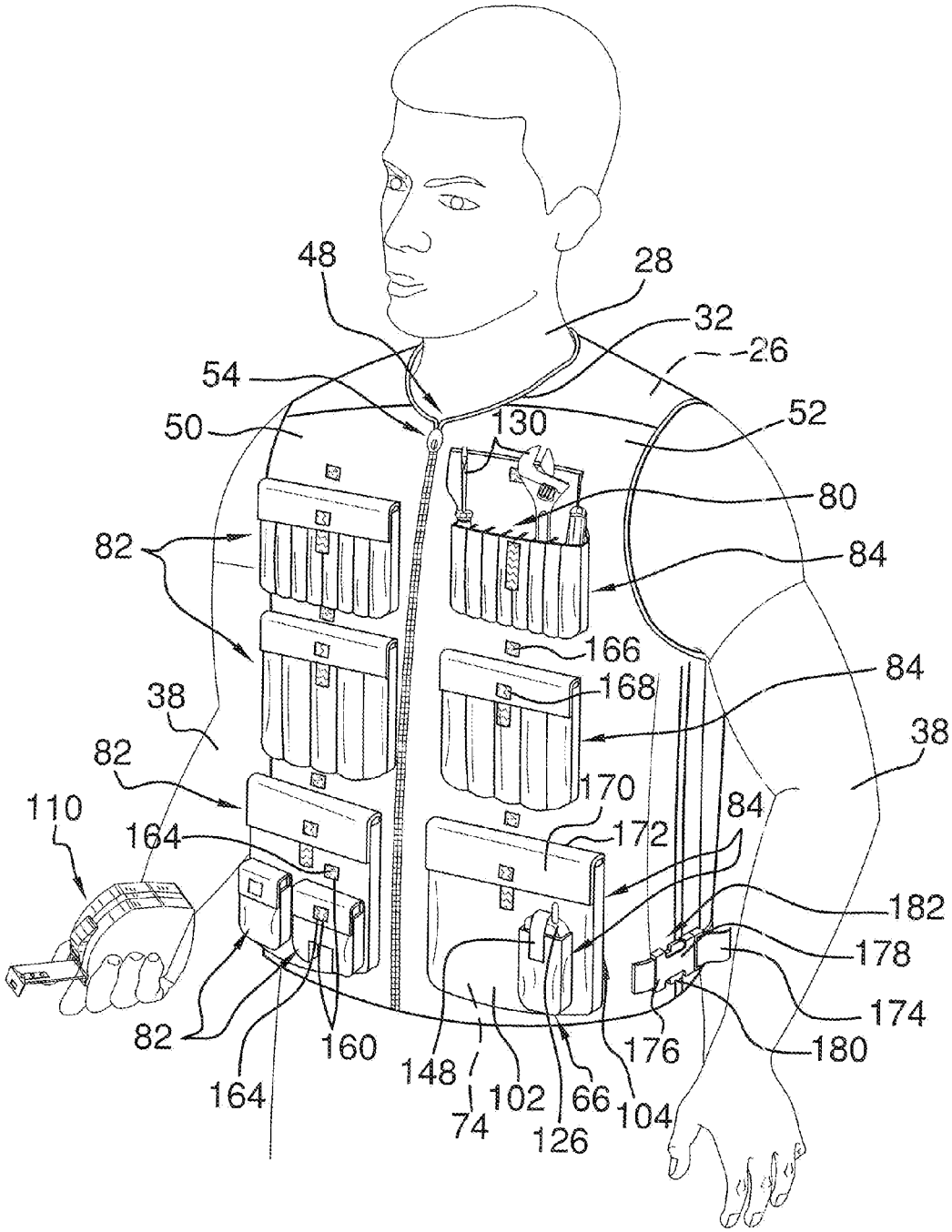
FIG. 1 is a top front side perspective view of a tool kit vest assembly according to an embodiment of the disclosure in use.
Figure 2:
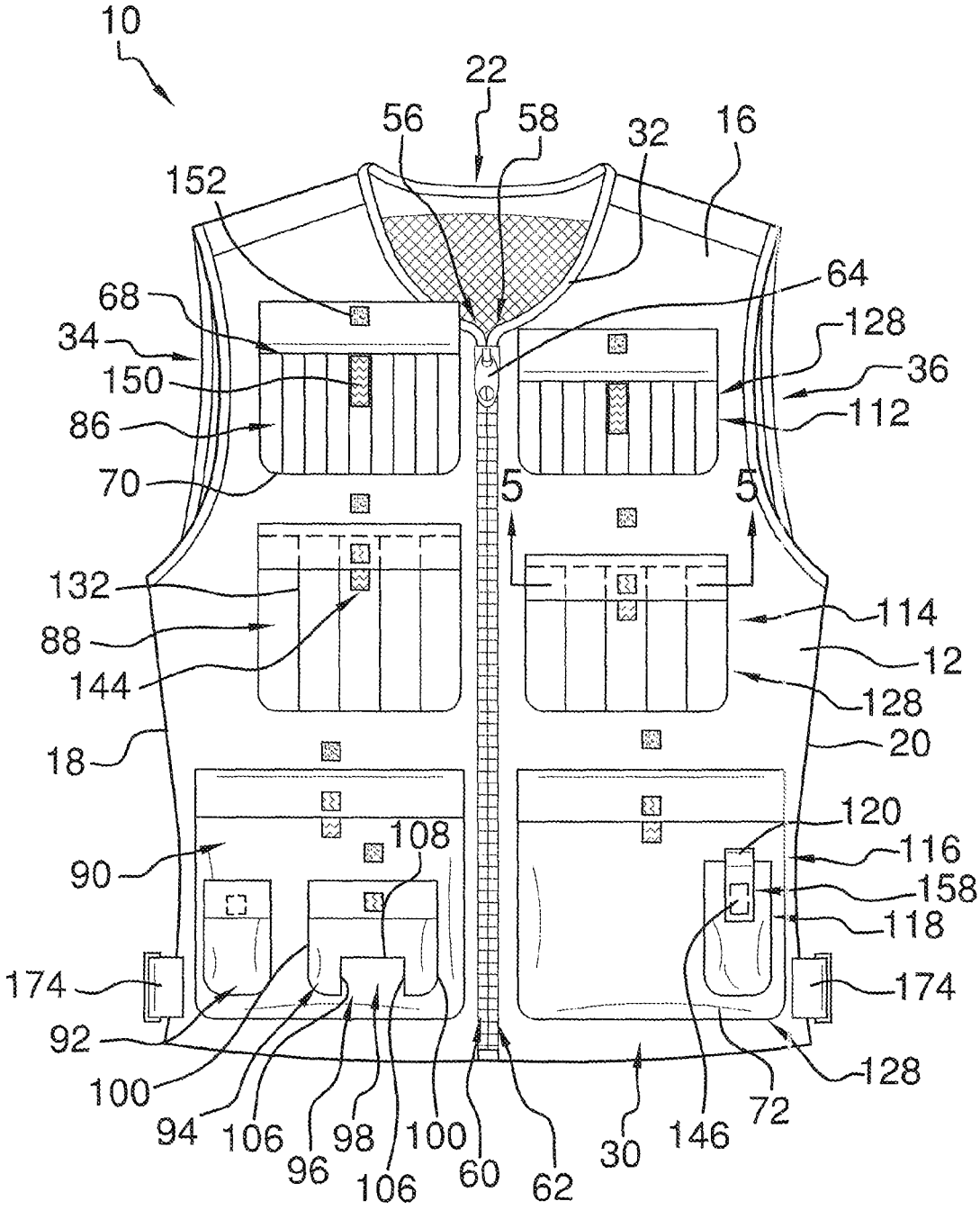
FIG. 2 is a front view of an embodiment of the disclosure.
Figure 3:
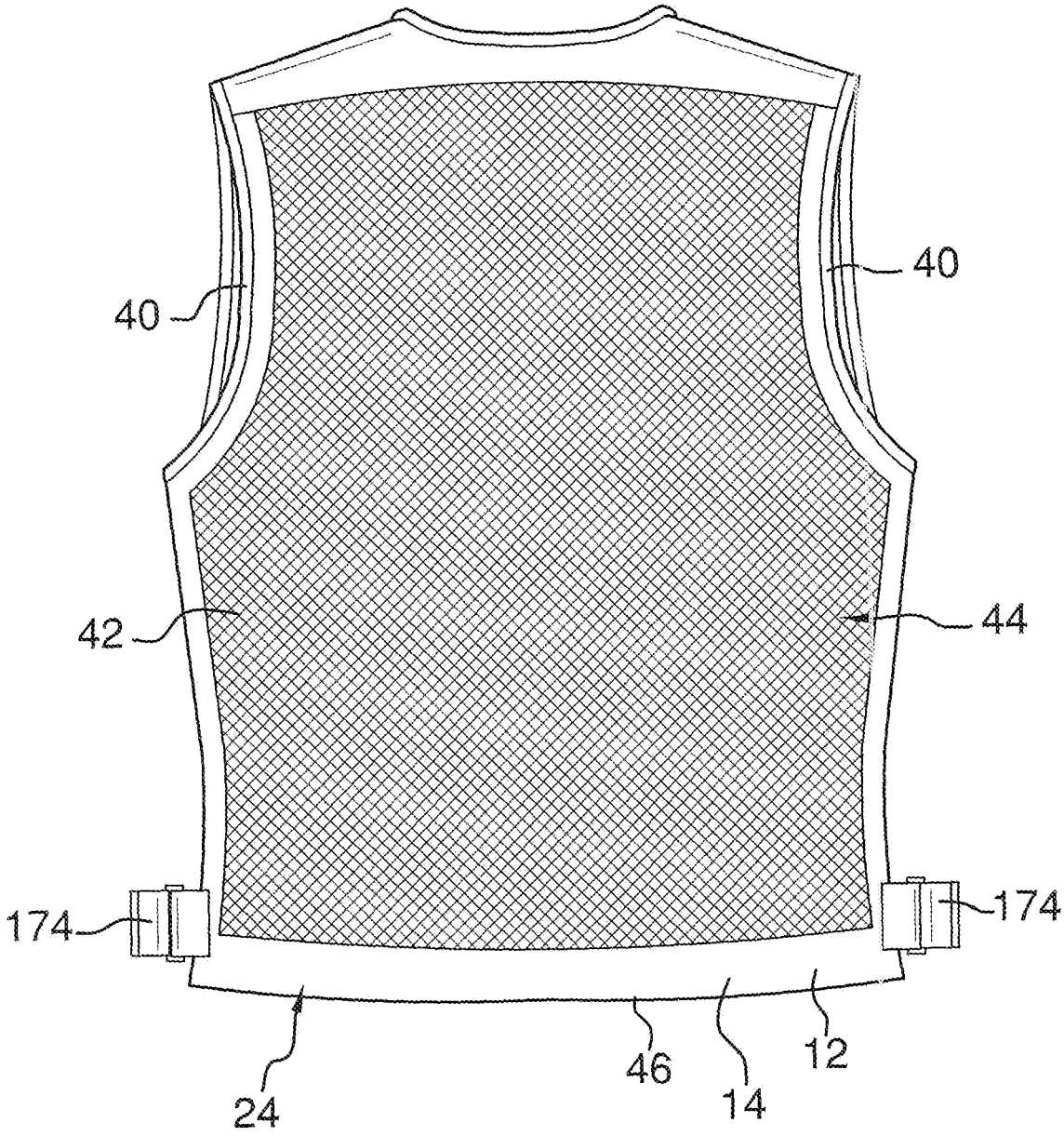
FIG. 3 is a back, view of an embodiment of the disclosure.
Figure 4:
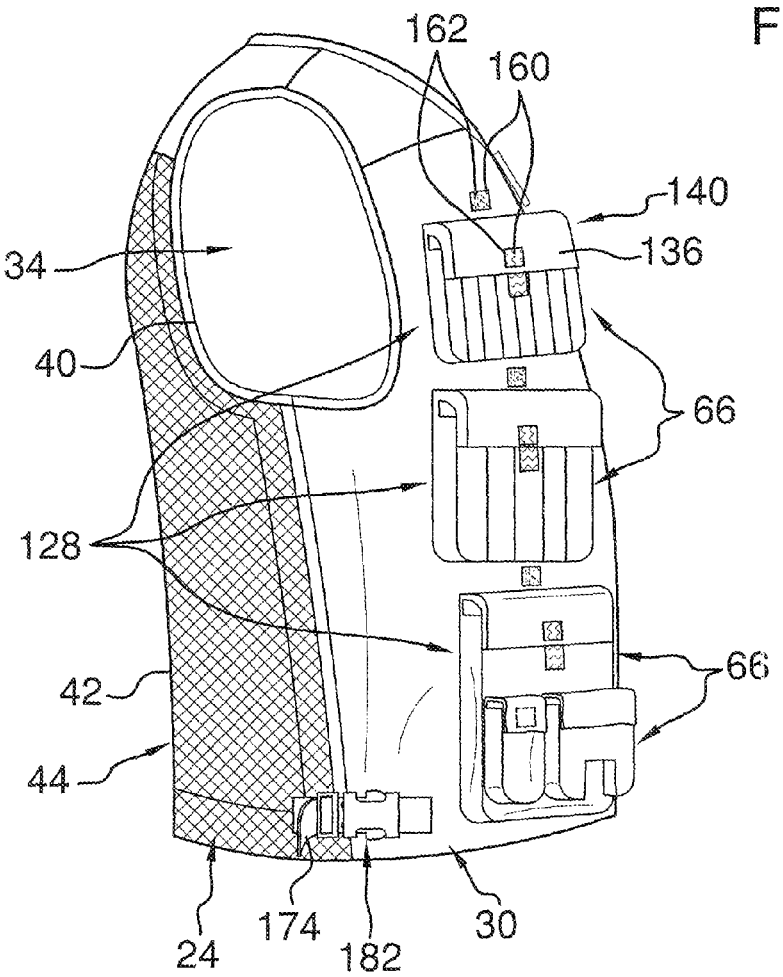
FIG. 4 is a side view of an embodiment of the disclosure.
Figure 5:
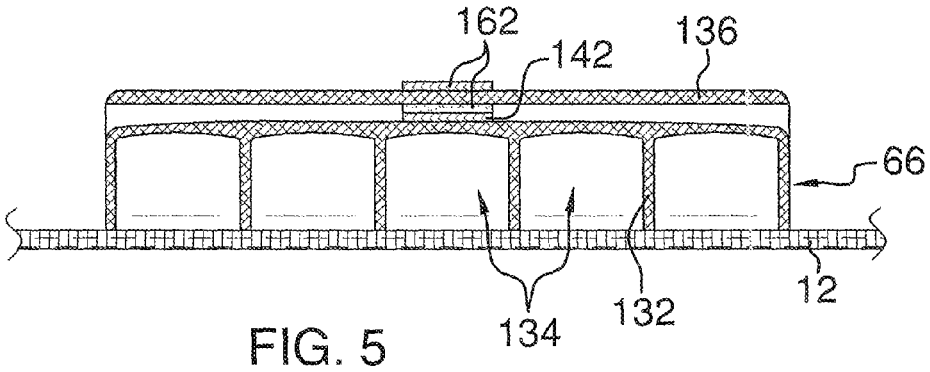
FIG. 5 is a cross-sectional view of an embodiment of the disclosure taken along line 5-5 of FIG. 2.
Figure 6:
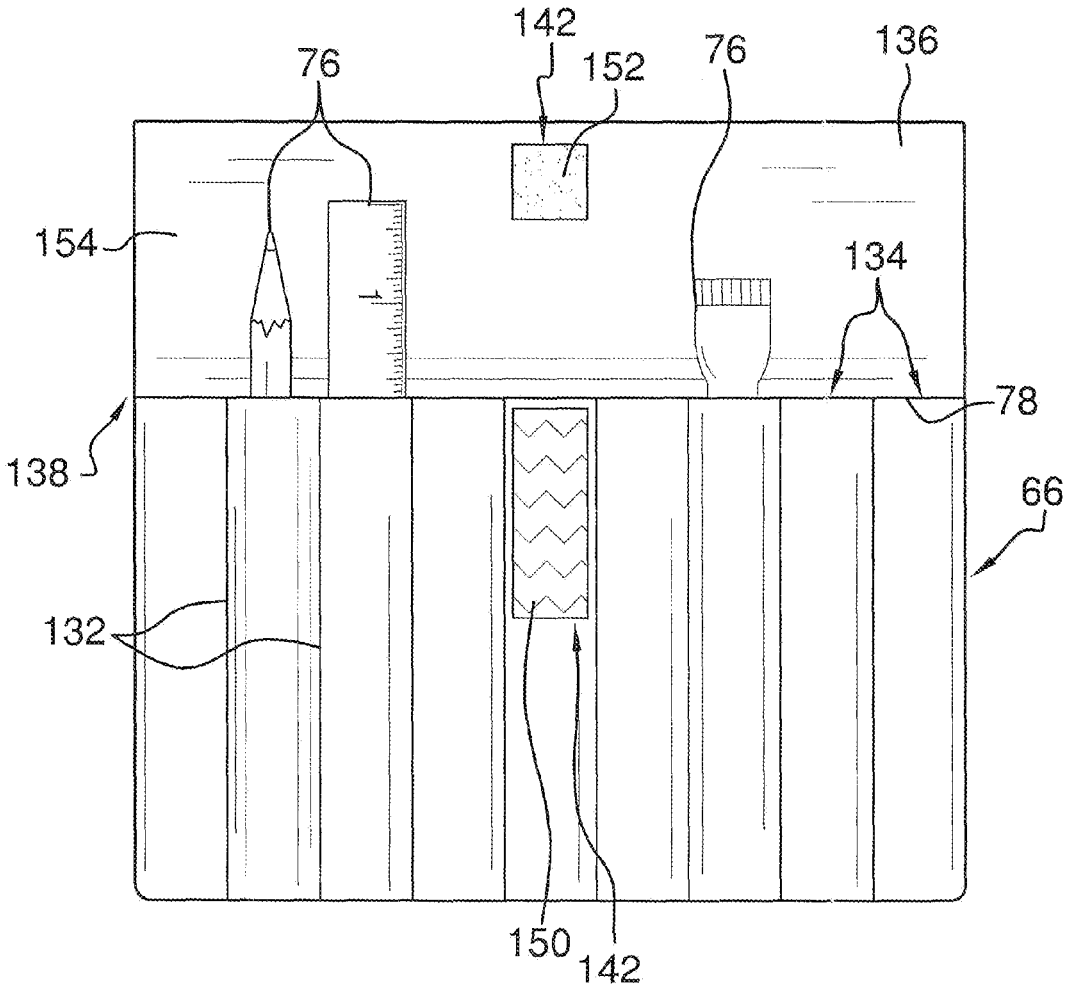
FIG. 6 is a front view of a pocket of an embodiment of the disclosure in use and in the opened position.

With reference now to the drawings, and in particular to FIGS. 1 through 6 thereof, a new vest assembly embodying the principles and concepts of an embodiment of the disclosure and generally designated by the reference numeral 10 will be described.

As best illustrated in FIGS. 1 through 6, the tool kit vest assembly 10 generally comprises a flexible panel 12 having a first end 14, a second end 16, and a pair of lateral sides 18, 20 extending between the first end 14 and the second end 16. The panel 12 is preferably made from canvas or other lightweight material. An aperture 22 is positioned in the panel 12 between the first end 14 and the second end 16 and between the lateral sides 18, 20 of the panel 12. The aperture 22 defines a dorsal portion 24 of the panel 12 extending from the aperture 22 to the first end 14 of the panel 12 when the panel 12 is draped over shoulders 26 of a person while a neck. 28 of the person extends through the aperture 22. The aperture 22 further defines a ventral portion 30 of the panel 12 extending from a forward edge 32 of the aperture 22 to the second end 16 of the panel 12 when the panel 12 is draped over the shoulders 26 of the person while the neck 28 of the person is positioned in the aperture 22. The forward edge 32 of the aperture 22 12 is preferably U-shaped. A pair of holes 34, 36 is positioned in the panel 12 between the first end 14 and the second end 16. Each of the holes 34, 36 is positioned in an associated one of the lateral sides 18, 20 proximate the aperture 22 wherein the holes 34, 36 are configured for receiving a person's arms 38 therethrough when the panel 12 is draped over the shoulders 26 of the person and the neck 28 of the person is positioned in the aperture 22. An outer edge 40 of each of the holes 34, 36 is concavely curved into the ventral and dorsal portions 30, 24 of the panel 12.

A plurality of interwoven strands 42 is coupled to the first end 14 of the panel 12 wherein the strands 42 define a semi-permeable barrier 44 in the panel 12 configured to prevent heat from accumulating in the panel 12. The strands 42 extend between the lateral sides 18, 20 of the panel 12. The strands 42 are offset from the aperture 22, a bottom edge 46 of the panel 12, and the lateral sides 18, 20 of the panel 12. The strands 42 are offset from the aperture 22 and the bottom edge 46 of the panel 12 a greater distance than the strands 42 are offset from the lateral sides 18, 20. The dorsal portion 24 of the panel 12 surrounding the strands 42 is of increased strength as compared to the ventral portion 30 of the panel 12 so as to provide increased stiffness for areas of high stress. Similarly, the panel 12 is of increased strength surrounding the aperture 22 and above the shoulders 26 of the person when the panel is draped over the shoulders 26 of the person. A slit 48 extends between the second end 16 of the panel 12 and the aperture 22. The slit 48 extends transversely between the aperture 22 and the second end 16 of the panel 12 and defines a first side 50 and a second side 52 of the second end 16. A slide fastener 54 is coupled to opposite edges 56, 58 of the slit 48. The slide fastener 54 comprises a pair of complementary toothed tracks 60, 62 and a graspable portion 64. The graspable portion 64 is coupled to the toothed tracks 60, 62 wherein the graspable portion 64 interlocks the toothed tracks 60, 62 when pulled upwardly toward the aperture 22 and separates the toothed tracks 60, 62 when pulled downwardly away from the aperture 22.

A plurality of pockets 66 is coupled to the panel 12. Each of the pockets 66 has an open top end 68, a closed bottom end 70, a perimeter wall 72, and a front side 102 positioned opposite a back side 104. The perimeter wall 72 extends between the open top end 68 and the closed bottom end 70. The closed bottom end 70 and the perimeter wall 72 define an interior space 74 configured for holding a plurality of items 76. A top edge 78 of the perimeter wall 72 defines an opening 80 into the interior space 74. The plurality of pockets 66 further comprises a first pocket array 82 and a second pocket array 84. The first pocket array 82 is coupled to the first side 50 of the second end 16 of the panel 12. The pockets 66 of the first pocket array 82 comprise a first pocket 86, a second pocket 88, a third pocket 90, a fourth pocket 92, and a fifth pocket 94. The first pocket 86 is positioned proximate the aperture 22. The third pocket 90 is positioned distally relative to the aperture 22. The second pocket 88 is positioned between the first pocket 86 and the third pocket 90. The fourth and fifth pockets 92, 94 are coupled to the third pocket 90. The fourth and fifth pockets 92, 94 are spaced and horizontally aligned. The fifth pocket 94 is positioned nearer the slide fastener 54 than the fourth pocket 92. The fourth pocket 92 may hold a handheld transceiver device. A medial section 96 of the fifth pocket 94 defines a notch 98 extending into the closed bottom end 70 of the fifth pocket 94. The notch 98 is positioned between opposite ends 100 of the fifty pocket 94. The notch 98 extends between the front side and back side 102, 104 of the fifth pocket 94. The notch 98 has a pair of opposed ends 106 and a medial portion 108 coupling the opposed ends 106 wherein the fifth pocket 94 has a size and shape configured to receive a tape measuring tool 110.

The second pocket array 84 is coupled to the second side 52 of the second end 16 of the panel 12. The pockets 66 of the second pocket array 84 comprise a top pocket 112, a middle pocket 114, a bottom pocket 116, and a supplemental pocket 118. The top pocket 112 is positioned proximate the aperture 22. The bottom pocket 116 is positioned distally relative to the aperture 22. The middle pocket 114 is positioned between the top pocket 112 and the bottom pocket 116. A strap 120 extends across the opening 80 of the supplemental pocket 118. The strap 120 extends from the front side 102 to the back side 104 of the supplemental pocket 118 wherein the strap 120 is configured to secure an electronic device 126, such as a cell phone, within the interior space 74 of the supplemental pocket 118.

The first pocket 86, the second pocket 88, the third pocket 90, the top pocket 112, the middle pocket 114, and the bottom pocket 116 define main pockets 128. The interior space 74 of the main pockets 128 is configured to hold a plurality of tools 130. The main pockets 128 of the first pocket array 82 are spaced and vertically aligned. The main pockets 128 of the second pocket array 84 are spaced and vertically aligned. A plurality of spaced vertical partitions 132 is coupled to the top pocket 112, the middle pocket 114, the first pocket 86, and the second pocket 88. The partitions 132 extend through the interior space 74 and define a plurality of compartments 134 within the pockets 66 wherein the compartments 134 are configured for organizing and separating tools 130 placed within the pockets 66. A length of the pockets 66 extends from each of the open top ends 68 to an associated one of the closed bottom ends 70. The third pocket 90 and the bottom pocket 116 are equal in length wherein each has a length between approximately 10 centimeters and 30 centimeters. The second pocket 88 has a longer length than the middle pocket 114 wherein the second pocket 88 has a length between approximately 10 centimeters and 20 centimeters and the middle pocket 114 has a length between approximately 8 centimeters and 18 centimeters. The first rocket 86 has a longer length than the top pocket 112 wherein the first pocket 86 has a length between approximately 5 centimeters and 15 centimeters and the top pocket 112 has a length between approximately 3 centimeters and 12 centimeters.

A flap 136 is coupled to the main pockets 128 and the fourth and fifth pockets 92, 94. The flap 136 is positionable between an opened position 138 and a closed position 140 wherein the flap 136 closes the opening 80 when the flap 136 is in the closed position 140 and the flap 136 exposes the opening 80 when the flap 136 is in the opened position 138. A pair of interior fasteners 142 is provided. A first one 144 of the interior fasteners 142 couples each of the flaps 136 to the pockets 66 when the flaps 136 are in the closed position 140. The interior fasteners 142 enable the flaps 136 to remain in the closed position 140 when desired. A second one 146 of the interior fasteners 142 couples a first end 148 of the strap 120 to the supplemental pocket 118. The interior fasteners 142 are complementary portions 150, 152 of hook and loop fastener. One of the complementary portions 150, 152 of hook and loop fastener of the first one 144 of the interior fasteners 142 is a square-shaped strip coupled to an inside face 154 of the flaps 136. One of the complementary portions 150, 152 of hook and loop fastener of each of the first and second one 144, 146 of the interior fasteners 142 is an elongated strip positioned vertically on the front side 102 of the pockets 66. One of the complementary portions 150, 152 of hook and loop fastener of the second one 146 of the interior fasteners 142 is coupled to an inner face 158 of the first end 148 of the strap 120. The complementary portions 150, 152 of hook and loop fastener of the interior fasteners 142 are vertically aligned.

A pair of exterior fasteners 160 is provided. A first one 162 of the exterior fasteners 160 couples the flaps 136 of the main pockets 128 to the panel 12 when the flaps 136 are in the opened position 138. A second one 164 of the exterior fasteners 160 couples the flap 136 of the fifth pocket 94 to the third pocket 90 when the flap 136 is in the opened position 138. The exterior fasteners 160 permit the flaps 136 to remain in the opened position 138 when desired. The exterior fastener 160 may be complementary portions 166, 168 of hook and loop fastener. The complementary portions 166, 168 of hook and loop fastener of the exterior fastener 160 are vertically aligned. Each of the complementary portions 166, 168 of hook and loop fastener of the exterior fastener 160 is a square-shaped strip. One of the complementary portions 166, 168 of hook and loop fastener of each of the first and second one 162, 164 of the exterior fasteners 160 is coupled to an exterior face 170 of the flap 136. One of the complementary portions 166, 168 of hook and loop fastener of the first one 162 of the exterior fasteners 160 is coupled to the panel 12 proximate an upper edge 172 of the flap 136. One of the complementary portions 166, 1.68 of hook and loop fastener of the second one 164 of the exterior fasteners 160 is coupled to the front side 102 of the third pocket 90.

Each of the exterior fasteners 160 has a length equal to its width wherein the length and width are each between approximately 0.5 centimeters and 3 centimeters. Each of the elongated strips of the interior fasteners 142 has a width between approximately 0.5 centimeters and 2 centimeters and a length between approximately 2 centimeters and 8 centimeters.

A loop 183 is coupled to the second side 52 of the second end 66. The loop 183 is positioned below the bottom pocket 116 nearer to the slit 48 than the lateral side 20. The loop 183 is arcuate and has a first end 184 spaced from a second end 136. The loop 183 extends outwardly from the panel 12 wherein the loop 183 is configured for holding a hammer therein. A pair of first fasteners 188 couples the first end 184 of the loop 183 to the panel 12. A pair of second fasteners 190 couples the second end 186 of the loop 183 to the panel 12.

The pairs of first and second fasteners 188, 190 are preferably rivets, though other conventional fasteners may be used instead. The loop 183 is preferably comprised of leather, though other suitable materials fall within the scope of the invention. The loop 183 has a thickness between approximately 0.05 centimeters and 2.0 centimeters, a height between approximately 1.5 centimeters and 4.5 centimeters, and a length between approximately 5.0 centimeters and 10.0 centimeters.

A pair of glove holders 192 is coupled to the panel 12. Each of the glove holders 192 is positioned on an associated one of the first side 50 and the second side 52 of the second end 16 proximate the aperture 22. Each of the glove holders 192 comprises a loop having a first end 194 spaced from a second end 196. The glove holders 192 extend outwardly from the panel 12 wherein each of the glove holders 192 is configured for holding one of a pair of gloves therein. The glove holders 192 are preferably stitched to the area of the panel 12 having increased strength and are preferably constructed from the same material as that of the panel 12. An inner fastener 198 is coupled to the panel 12 and to an inner surface of each of the first and second ends 194, 196 of the glove holders 192 such that the inner fastener 198 couples the glove holders 192 to the panel 12. The inner fastener 198 may be complementary portions of a hook and loop fastener. The inner fastener 198 preferably has the same dimensions as each of the exterior fasteners 160.

A pair of side straps 174 is coupled to the panel 12. Each of the side straps 174 is positioned on an associated one of the lateral sides 18, 20 of the panel 12. The side straps 174 extend from the first end 14 to the second end 16 of the panel 12. A side fastener 176 is coupled to each of the side straps 174. The side fastener 176 comprises first and second complementary portions 178, 180 wherein the first and second complementary portions 178, 180 are selectively engaged to permit adjustability of the panel 12 via adjustment of the side straps 174. Each the side fasteners 176 preferably comprises a buckle 182.

In use, as stated above and shown in the Figures, the panel 12 is secured around the neck 28 of a person, such that the panel 12 is draped over the torso and shoulders 26 of the person, while the neck 28 of the person extends through the aperture 22. The graspable portion 64 of the slide fastener 54 is pulled upwardly toward the aperture 22 so as to interlock the toothed tracks 60, 62. The side straps 174 are adjusted to adjust the panel 12. Items 76, such as tools 130 and electronic devices 126, are placed in the pockets 66. The flaps 136 are moved to the closed position 140 to secure the items 76 within the interior space 74 of the pockets 66. The flaps 136 are moved to the opened position 138 to retrieve the items 76 when desired. To remove the panel 12, the graspable portion 64 of the slide fastener 54 is pulled downwardly away from the aperture 22 so as to separate the toothed tracks 60, 62.

With respect to the above description then, it is to be realized that the optimum dimensional relationships for the parts of an embodiment enabled by The disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A tool kit vest assembly comprising:

a flexible panel having a first end, a second end, and a pair of lateral sides extending between said first end and said second end;

an aperture being positioned in said panel between said first end and said second end and between said lateral sides of said panel, said aperture defining a dorsal portion of said panel extending from said aperture to said first end of said panel when said panel is draped over shoulders of a person while a neck of the person extends through said aperture;

a pocket coupled to said panel, said pocket having an open top end, a closed bottom end, and a perimeter wall extending between said open top end and said closed bottom end, said closed bottom end and said perimeter wall defining an interior space configured for holding a plurality of tools;

a top edge of said perimeter wall defining an opening into said interior space;

a flap coupled to said pocket, said flap being positionable between an opened position and a closed position wherein said flap closes said opening when said flap is in the closed position and said flap exposes said opening when said flap is in the opened position;

an interior fastener coupling said flap to said pocket when said flap is in the closed position; and an exterior fastener coupling said flap to said panel when said flap is in the opened position; and a plurality of interwoven strands coupled to said first end of said panel wherein said strands define a semi-permeable barrier in said panel configured to prevent heat from accumulating in said panel, said strands extending between said lateral sides of said panel.

2. The assembly of claim 1, further comprising said strands being offset from each of said aperture, a bottom edge of said panel, and said lateral sides of said panel, said strands being offset from said aperture and said bottom edge of said panel a greater distance than said strands are offset from said lateral sides.

3. The assembly of claim 1, further comprising:

a slit extending between said second end of said panel and said aperture, said slit extending transversely between said aperture and said second end of said panel and defining a first side and a second side of said second end; and a slide fastener coupled to opposite edges of said slit, said slide fastener comprising a pair of complementary toothed tracks and a graspable portion; and wherein said graspable portion is coupled to said toothed tracks such that said graspable portion interlocks said toothed tracks when pulled upwardly toward said aperture and separates said toothed tracks when pulled downwardly away from said aperture.

4. The assembly of claim 3, further comprising:

said pocket being one of a plurality of pockets wherein each of said pockets has a front side positioned opposite a back side; and said flap being one of a plurality of flaps, each of said flaps being coupled to an associated one of said pockets.

5. The assembly of claim 4, further comprising:

a first pocket array coupled to said first side of said second end of said panel;

a second pocket array coupled to said second side of said second end of said panel.

6. The assembly of claim 5, further comprising:

said pockets of said first pocket array comprising a first pocket, a second pocket, a third pocket, a fourth pocket, and a fifth pocket, said first pocket being positioned proximate said aperture, said third pocket being positioned distally relative to said aperture, said second pocket being positioned between said first pocket and said third pocket, said fourth and fifth pockets being coupled to said third pocket; and said pockets of said second pocket array comprising a top pocket, a middle pocket, a bottom pocket, and a supplemental pocket, said top pocket being positioned proximate said aperture, said bottom pocket being positioned distally relative to said aperture, and said middle pocket being positioned between said top pocket and said bottom pocket.

7. The assembly of claim 6, further comprising:

wherein a length of said pockets extends from each of said open top ends to an associated one of said closed bottom ends; and wherein said third pocket and said bottom pocket are equal in length, said second pocket is longer than said middle pocket, and said first pocket is longer than said top pocket.

8. The assembly of claim 6, further comprising:

wherein said first pocket, said second pocket, said third pocket, said top pocket, said middle pocket, and said bottom pocket define main pockets, said interior space of said main pockets being configured to hold a plurality of tools;

wherein said main pockets of said first pocket array are spaced and vertically aligned; and wherein said main pockets of said second pocket array are spaced and vertically aligned.

9. The assembly of claim 6, further comprising a plurality of spaced vertical partitions coupled to said top pocket, said middle pocket, said first pocket, and said second pocket, said partitions extending through said interior space and defining a plurality of compartments within said pockets wherein said compartments are configured for organizing and separating tools placed within said pockets.

10. The assembly of claim 8, further comprising:

a strap extending across said opening of said supplemental pocket, said strap extending from said front side to said back side of said supplemental pocket wherein said strap is configured to secure an electronic device within said interior space of said supplemental pocket;

said flaps being coupled to each said main pockets and said fourth and fifth pockets;

said interior fastener being one of a pair of interior fasteners wherein a first one of said interior fasteners couples each of said flaps to said pockets when said flaps are in the closed position and a second one of said interior fasteners couples a first end of said strap to said supplemental pocket.

11. The assembly of claim 10, further comprising:

said interior fasteners being complementary portions of hook and loop fastener;

wherein one of said complementary portions of hook and loop fastener of said first one of said interior fasteners is a square-shaped strip coupled to an inside face of said flaps;

wherein one of said complementary portions of hook and loop fastener of said second one of said interior fasteners is coupled to an inner face of said first end of said strap; and wherein one of said complementary portions of hook and loop fastener of each of said first and second one of said interior fasteners is an elongated strip positioned vertically on said front side of said pockets.

12. The assembly of claim 8, further comprising said exterior fastener being one of a pair of exterior fasteners wherein a first one of said exterior fasteners couples said flaps of said main pockets to said panel when said flaps are in the opened position and a second one of said of said exterior fasteners couples said flap of said fifth pocket to said third pocket when said flap is in the opened position.

13. The assembly of claim 12, further comprising:

said exterior fasteners being complementary portions of hook and loop fastener wherein each of said complementary portions of hook and loop fastener of said exterior fasteners are square-shaped strips;

wherein one of said complementary portions of hook and loop fastener of each of said first and second one of said exterior fasteners is coupled to an exterior face of said flap;

wherein one of said complementary portions of hook and loop fastener of said first one of said exterior fasteners is coupled to said panel proximate an upper edge of said flap; and wherein one of said complementary portions of hook and loop fastener of said second one of said exterior fasteners is coupled to said front side of said third pocket.

14. The assembly of claim 6, further comprising:

a medial section of said fifth pocket defining a notch extending into said closed bottom end of said fifth pocket;

wherein said notch is positioned between opposite ends of said fifth pocket and extends between said front side and said back side of said fifth pocket; and wherein said notch has a pair of opposed ends and a medial portion coupling said opposed ends such that said fifth pocket has a size and shape configured to receive a tape measuring tool.

15. The assembly of claim 1, further comprising:

a pair of side straps coupled to said panel, each of said side straps being positioned on an associated one of said lateral sides of said panel, said side straps extending from said first end to said second end of said panel; and a side fastener coupled to each of said side straps, said side fastener comprising first and second complementary portions wherein said first and second complementary portions are selectively engaged to permit adjustability of said panel via adjustment of said side straps.

16. The assembly of claim 15, further comprising each said side fasteners being a buckle.

17. The assembly of claim 4, further comprising:

a pair of glove holders being coupled to said panel, each of said glove holders being positioned on an associated one of said first side and said second side of said second end proximate said aperture, each of said glove holders comprising a loop having a first end spaced from a second end, said glove holders extending outwardly from said panel wherein each of said glove holders is configured for holding one of a pair of gloves therein; and an inner fastener being coupled to said panel and to an inner surface of each of said first and second ends of said glove holders such that said inner fastener couples said glove holders to said panel, said inner fastener comprising complementary portions of hook and loop fastener.

18. The assembly of claim 6, further comprising:

a loop being coupled to said second side of said second end, said loop being positioned below said bottom pocket proximate said slit, said loop being arcuate, said loop having a first end spaced from a second end, said loop extending outwardly from said panel wherein said loop is configured to hold a hammer therein; and a pair of first and second fasteners, said pair of first fasteners coupling said first end of said loop to said panel, said pair of second fasteners coupling said second end of said loop to said panel.

19. A tool kit vest assembly comprising:

a flexible panel having a first end, a second end, and a pair of lateral sides extending between said first end and said second end;

an aperture being positioned in said panel between said first end and said second end and between said lateral sides of said panel, said aperture defining a dorsal portion of said panel extending from said aperture to said first end of said panel when said panel is draped over shoulders of a person while a neck of the person extends through said aperture, said aperture further defining a ventral portion of said panel extending from a forward edge of said aperture to said second end of said panel when said panel is draped over the shoulders of the person while the neck of the person is positioned in said aperture, said forward edge of said aperture being U-shaped;

a pair of holes, said holes being positioned in said panel between said first end and said second end, each of said holes being positioned in an associated one of said lateral sides proximate said aperture wherein said holes are configured for receiving a person's arms therethrough when said panel is draped over the shoulders of the person and the neck of the person is positioned in said aperture, an outer edge of each of said holes being concavely curved into said ventral and dorsal portions of said panel;

a plurality of interwoven strands coupled to said first end of said panel wherein said strands define a semi-permeable barrier in said panel configured to prevent heat from accumulating in said panel, said strands extending between said lateral sides of said panel, said strands being offset from each of said aperture, a bottom edge of said panel, and said lateral sides of said panel, said strands being offset from said aperture and said bottom edge of said panel a greater distance than said strands are offset from said lateral sides;

a slit extending between said second end of said panel and said aperture, said slit extending transversely between said aperture and said second end of said panel and defining a first side and a second side of said second end;

a slide fastener coupled to opposite edges of said slit, said slide fastener comprising a pair of complementary toothed tracks and a graspable portion, said graspable portion being coupled to said toothed tracks wherein said graspable portion interlocks said toothed tracks when pulled upwardly toward said aperture and separates said toothed tracks when pulled downwardly away from said aperture;

a plurality of pockets coupled to said panel, each of said pockets having an open top end, a closed bottom end, a perimeter wall, and a front side positioned opposite a back side, said perimeter wall extending between said open top end and said closed bottom end, said closed bottom end and said perimeter wall defining an interior space configured for holding a plurality of items, said plurality of pockets further comprising a first pocket array coupled to said first side of said second end of said panel, said pockets of said first pocket array comprising a first pocket, a second pocket, a third pocket, a fourth pocket, and a fifth pocket, said first pocket being positioned proximate said aperture, said third pocket being positioned distally relative to said aperture, said second pocket being positioned between said first pocket and said third pocket, said fourth and fifth pockets being coupled to said third pocket, said fourth and fifth pockets being spaced and horizontally aligned, said fifth pocket being positioned nearer said slide fastener than said fourth pocket;

a second pocket array coupled to said second side of said second end of said panel, said pockets of said second pocket array comprising a top pocket, a middle pocket, a bottom pocket, and a supplemental pocket, said top pocket being positioned proximate said aperture, said bottom pocket being positioned distally relative to said aperture, and said middle pocket being positioned between said top pocket and said bottom pocket;

a top edge of said perimeter wall defining an opening into said interior space;

wherein a length of said pockets extends from each of said open top ends to an associated one of said closed bottom ends;

wherein said third pocket and said bottom pocket are equal in length, said second pocket has a longer length than said middle pocket, and said first pocket has a longer length than said top pocket;

wherein said first pocket, said second pocket, said third pocket, said top pocket, said middle pocket, and said bottom pocket define main pockets, said interior space of said main pockets being configured to hold a plurality of tools;

wherein said main pockets of said first pocket array are spaced and vertically aligned;

wherein said main pockets of said second pocket array are spaced and vertically aligned;

wherein a medial section of said fifth pocket defines a notch extending into said closed bottom end of said fifth pocket, said notch being positioned between opposite ends of said fifth pocket, said notch extending between said front side and said back side of said fifth pocket, said notch having a pair of opposed ends and a medial portion coupling said opposed ends wherein said fifth pocket has a size and shape configured to receive a tape measuring tool;

a plurality of spaced vertical partitions coupled to said top pocket, said middle pocket, said first pocket, and said second pocket, said partitions extending through said interior space and defining a plurality of compartments within said pockets wherein said compartments are configured for organizing and separating tools placed within said pockets;

a strap extending across said opening of said supplemental pocket, said strap extending from said front side to said back side of said supplemental pocket wherein said strap is configured to secure an electronic device within said interior space of said supplemental pocket;

a flap coupled to said main pockets and said fourth and fifth pockets, said flap being positionable between an opened position and a closed position wherein said flap closes said opening when said flap is in the closed position and said flap exposes said opening when said flap is in the opened position;

a pair of interior fasteners, a first one of said interior fasteners coupling each of said flaps to said pockets when said flaps are in the closed position, a second one of said interior fasteners coupling a first end of said strap to said supplemental pocket, said interior fasteners being complementary portions of hook and loop fastener, one of said complementary portions of hook and loop fastener of said first one of said interior fasteners being a square-shaped strip coupled to an inside face of said flaps, one of said complementary portions of hook and loop fastener of each of said first and second one of said interior fasteners being an elongated strip positioned vertically on said front side of said pockets, one of said complementary portions of hook and loop fastener of said second one of said interior fasteners being coupled to an inner face of said first end of said strap, said complementary portions of hook and loop fastener of said interior fasteners being vertically aligned; and a pair of exterior fasteners, a first one of said exterior fasteners coupling said flaps of said main pockets to said panel when said flaps are in the opened position, a second one of said exterior fasteners coupling said flap of said fifth pocket to said third pocket when said flap is in the opened position, said exterior fastener being complementary portions of hook and loop fastener, said complementary portions of hook and loop fastener of said exterior fastener being vertically aligned, each of said complementary portions of hook and loop fastener of said exterior fastener being a square-shaped strip, one of said complementary portions of hook and loop fastener of each of said first and second one of said exterior fasteners being coupled to an exterior face of said flap, one of said complementary portions of hook and loop fastener of said first one of said exterior fasteners being coupled to said panel proximate an upper edge of said flap, one of said complementary portions of hook and loop fastener of said second one of said exterior fasteners being coupled to said front side of said third pocket;

a loop being coupled to said second side of said second end, said loop being positioned below said bottom pocket proximate said slit, said loop being arcuate, said loop having a first end spaced from a second end, said loop extending outwardly from said panel wherein said loop is configured to hold a hammer therein;

a pair of first and second fasteners, said pair of first fasteners coupling said first end of said loop to said panel, said pair of second fasteners coupling said second end of said loop to said panel;

a pair of glove holders being coupled to said panel, each of said glove holders being positioned on an associated one of said first side and said second side of said second end proximate said aperture, each of said glove holders comprising a loop having a first end spaced from a second end, said glove holders extending outwardly from said panel wherein each of said glove holders is configured for holding one of a pair of gloves therein;

an inner fastener being coupled to said panel and to an inner surface of each of said first and second ends of said glove holders such that said inner fastener couples said glove holders to said panel, said inner fastener comprising complementary portions of hook and loop fastener;

a pair of side straps coupled to said panel, each of said side straps being positioned on an associated one of said lateral sides of said panel, said side straps extending from said first end to said second end of said panel; and a side fastener coupled to each of said side straps, said side fastener comprising first and second complementary portions wherein said first and second complementary portions are selectively engaged to permit adjustability of said panel via adjustment of said side straps, each said side fasteners comprising a buckle.

20. A tool kit vest assembly comprising:

a flexible panel having a first end, a second end, and a pair of lateral sides extending between said first end and said second end;

an aperture being positioned in said panel between said first end and said second end and between said lateral sides of said panel, said aperture defining a dorsal portion of said panel extending from said aperture to said first end of said panel when said panel is draped over shoulders of a person while a neck of the person extends through said aperture;

a pocket coupled to said panel, said pocket having an open top end, a closed bottom end, and a perimeter wall extending between said open top end and said closed bottom end, said closed bottom end and said perimeter wall defining an interior space configured for holding a plurality of tools;

a top edge of said perimeter wall defining an opening into said interior space;

a flap coupled to said pocket, said flap being positionable between an opened position and a closed position wherein said flap closes said opening when said flap is in the closed position and said flap exposes said opening when said flap is in the opened position;

an interior fastener coupling said flap to said pocket when said flap is in the closed position;

an exterior fastener coupling said flap to said panel when said flap is in the opened position;

a slit extending between said second end of said panel and said aperture, said slit extending transversely between said aperture and said second end of said panel and defining a first side and a second side of said second end; and a slide fastener coupled to opposite edges of said slit, said slide fastener comprising a pair of complementary toothed tracks and a graspable portion;

said graspable portion being coupled to said toothed tracks such that said graspable portion interlocks said toothed tracks when pulled upwardly toward said aperture and separates said toothed tracks when pulled downwardly away from said aperture;

said pocket being one of a plurality of pockets wherein each of said pockets has a front side positioned opposite a back side;

said flap being one of a plurality of flaps, each of said flaps being coupled to an associated one of said pockets;

a first pocket array coupled to said first side of said second end of said panel;

a second pocket array coupled to said second side of said second end of said panel;

said pockets of said first pocket array comprising a first pocket, a second pocket, a third pocket, a fourth pocket, and a fifth pocket, said first pocket being positioned proximate said aperture, said third pocket being positioned distally relative to said aperture, said second pocket being positioned between said first pocket and said third pocket, said fourth and fifth pockets being coupled to said third pocket; and said pockets of said second pocket array comprising a top pocket, a middle pocket, a bottom pocket, and a supplemental pocket, said top pocket being positioned proximate said aperture, said bottom pocket being positioned distally relative to said aperture, and said middle pocket being positioned between said top pocket and said bottom pocket.

* * * * *